US006845780B2

(12) United States Patent
Bishirjian

(10) Patent No.: US 6,845,780 B2
(45) Date of Patent: Jan. 25, 2005

(54) PERSONAL CANOPY APPARATUS

(76) Inventor: Charles A. Bishirjian, 1161-9 Sheridan Rd. NE., Atlanta, GA (US) 30324

( * ) Notice: Subject to any disclaimer, the term of this patent is extended or adjusted under 35 U.S.C. 154(b) by 0 days.

(21) Appl. No.: 10/318,572

(22) Filed: Dec. 13, 2002

(65) Prior Publication Data

US 2004/0112416 A1 Jun. 17, 2004

(51) Int. Cl.[7] ..... E04H 15/02
(52) U.S. Cl. ..... 135/96
(58) Field of Search ..... 135/96, 90, 132, 135/133, 135, 20.1, 20.3, 16, 155; 297/184.15, 184.16, 184.17

(56) References Cited

U.S. PATENT DOCUMENTS

| | | | | |
|---|---|---|---|---|
| 437,336 | A | * 9/1890 | Giebel | 135/88.02 |
| 2,910,078 | A | * 10/1959 | Schunck | 135/27 |
| 3,007,735 | A | 11/1961 | Cohnard | |
| 3,032,046 | A | 5/1962 | Coonradt | |
| 3,890,989 | A | 6/1975 | Kuxhouse | |
| 4,069,833 | A | * 1/1978 | Johansson | 135/130 |
| 4,086,931 | A | 5/1978 | Hall | |
| 4,433,699 | A | 2/1984 | Schultes | |
| 4,781,411 | A | 11/1988 | Kolb | |
| 4,809,724 | A | 3/1989 | Fuser | |
| 4,836,232 | A | 6/1989 | De Rosa | |
| 4,865,381 | A | 9/1989 | VanRogue | |
| 4,915,120 | A | 4/1990 | Ziolkowski | |
| 4,930,838 | A | 6/1990 | Brabant | |
| 5,102,190 | A | 4/1992 | Akin | |
| 5,135,281 | A | 8/1992 | Pappalardo | |
| 5,203,363 | A | 4/1993 | Kidwell | |
| 5,215,109 | A | 6/1993 | Kent | |
| 5,240,020 | A | 8/1993 | Byers | |
| 5,255,954 | A | 10/1993 | Rogers | |
| 5,263,505 | A | 11/1993 | Yeom | |
| 5,320,405 | A | 6/1994 | Foster | |
| 5,441,067 | A | 8/1995 | James | |
| 5,579,797 | A | * 12/1996 | Rogers | 135/90 |
| D378,540 | S | 3/1997 | Becker | |
| 5,638,849 | A | 6/1997 | Scott | |
| 5,797,650 | A | 8/1998 | Gonzalez | |
| 5,806,547 | A | 9/1998 | Derlinga | |
| D399,367 | S | 10/1998 | Sieland | |
| 5,873,625 | A | 2/1999 | Uchtman | |
| 5,937,881 | A | 8/1999 | Villa | |
| 5,937,882 | A | 8/1999 | Harbaugh | |
| 6,116,256 | A | 9/2000 | Pawsey | |
| 6,244,286 | B1 | * 6/2001 | Russo | 135/128 |
| 6,296,002 | B1 | 10/2001 | Tashchyan | |
| 6,422,252 | B1 | 7/2002 | Pilz et al. | |
| 2003/0010371 | A1 | * 1/2003 | Langley | 135/117 |

FOREIGN PATENT DOCUMENTS

| | | |
|---|---|---|
| DE | 3536049 A1 | 4/1987 |
| FR | 1250940 A | 1/1961 |
| GB | 2216850 A | 10/1989 |

* cited by examiner

*Primary Examiner*—Ramon O. Ramirez
*Assistant Examiner*—Kofi Schulterbrandt
(74) *Attorney, Agent, or Firm*—Charles J. Prescott

(57) ABSTRACT

A personal canopy apparatus connectable to a separate structure. The canopy apparatus includes a main spine connectable to the separate structure, a top spine pivotally connected in a generally forwardly extending orientation to an upper end of said main spine, and a retractable canopy. The canopy includes two flexible covers each supported along a proximal edge by the top spine. A leading edge support arm and battens are supportively connected to each of the covers and are pivotally connected at a proximal end about one of two closely spaced third pivotal axes at a distal end of the top spine. When each of the covers are open in a fan-like manner, the support arms extend laterally in opposite directions from the top spine to form a leading edge of the canopy. The support arms, covers and battens are stored in closely aligned fashion within a substantially hollow length of said top spine.

11 Claims, 19 Drawing Sheets

PERSONAL CANOPY APPARATUS

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to devices and apparatus for providing personal protection from the weather elements, namely sun, rain and wind, and more particularly to a retractable personal canopy apparatus for an individual which is connectable to a separate support structure and having uniquely configured features thereof.

2. Description of Related Art

For those who work and play in the outdoors, whether hunting, fishing, boating, stadium watching, camping, beach going, farming, gardening, relaxing and the like, where the activity places the individual in a situation where the elements of weather such as excessive sunlight, wind and rain, or the presence of insects, cause an individual discomfort and/or impose excessively adverse weather or environmental conditions, a broad array of inventions have been developed to offer various levels of protection from those conditions. The following U.S. and foreign patents are known to applicant which represent a broad array of such devices and apparatus for providing physical comfort when individuals are subjected to the elements of nature:

U.S. Pat. No. 4,836,232 to De Rosa
U.S. Pat. No. 6,244,286 to Russo
U.S. Pat. No. 5,255,954 to Rogers
U.S. Pat. No. 4,809,724 to Fuser
U.S. Pat. No. 4,915,120 to Ziolkowski
U.S. Pat. No. 5,203,363 to Kidwell
U.S. Pat. No. 5,215,109 to Kent, Jr.
U.S. Pat. No. 5,240,020 to Byers
U.S. Pat. No. 4,781,411 to Kolb
U.S. Pat. No. 4,433,699 to Schultes
U.S. Pat. No. 6,422,252 to Pilz
U.S. Pat. No. 3,032,046 to Coonradt
U.S. Pat. No. 4,389,057 to Richard, Jr.
U.S. Pat. No. 5,932,258 to Francois
U.S. Pat. No. 4,440,187 to Fiddler
U.S. Pat. No. D378,540 to Becker
U.S. Pat. No. 3,007,735 to Cohn
U.S. Pat. No. 4,086,931 to Hall
U.S. Pat. No. 3,890,989 to Kuxhouse
U.S. Pat. No. 4,069,833 to Johansson
U.S. Pat. No. 5,263,505 to Yeom
U.S. Pat. No. 6,296,002 to Tashchyan U.S. Pat. No. 5,937,882 to Harbaugh
U.S. Pat. No. 5,937,881 to Villa
U.S. Pat. No. 5,806,547 to Derlinga
U.S. Pat. No. 5,320,405 to Foster
U.S. Pat. No. 5,102,190 to Akin
U.S. Pat. No. 4,865,381 to Van Rogue
U.S. Pat. No. 5,873,625 to Uchtman
U.S. Pat. No. 5,797,650 to Gonzalez, Jr.
U.S. Pat. No. 5,579,797 to Rogers
U.S. Pat. No. 6,116,256 to Pawsey
U.S. Pat. No. Des. 399,367 to Sieland
U.S. Pat. No. 5,135,281 to Pappalardo
U.S. Pat. No. 5,441,067 to James
U.S. Pat. No. 4,930,838 to Brabant
U.S. Pat. No. 5,638,849 to Scott
DE3536049A1 to Fantasia GmbH
FR1250940A to Glatz
GB2216850A to Balurn Limited A number of these prior art disclosures are somewhat more related to the present invention. For example, the Pilz '252 patent discloses a sun protection device with a fan-like sunshade coupled to a support pole via a pivotal joint.

In the '046 patent, Coonradt discloses a collapsible awning for use on small boats, one of the applicant's targeted modes of use for the present invention. However, Coonradt teaches that the awning panel has edge flaps and wraps around a frame and secured by fasteners thereto. A separate clamp is used to attached the Coonradt device to a gunnel of a small boat.

Schultes, in the '699 patent and Johansson in the '833 patent also discloses sunshade frames which are retractable from a semi-circular shape to a compact pole-like shape.

Kolb in U.S. Pat. No. '411 also discloses a portable sunshield constructed of PVC piping for quick attachment to a bracket assembly of a fisherman's chair. In U.S. Pat. No. '020, Byers, teaches a retractable fisherman's sunshade wherein, when the fisherman stands up to stretch or to reel in a fish, the sunshade will automatically pivot upwardly out of the way of the head and shoulders of the fisherman.

The weather shelter invented by Kent in U.S. Pat. No. '109 teaches a weather shelter having a multi-positional placement adjustment and formed of an arcuate lightweight framework over which a flexible cover is stretched and anchored. A portable canopy attachment invented by Kidwell in U.S. Pat. No. '363 also teaches a portable device insertable into the ground and having a horizontally extendable canopy member for sun and rain protection.

In U.S. Pat. No. '724, Fuser teaches a sunshade holder uniquely attachable to the side margins of the back of a lawn or beach-type chair for weight economy and simplicity. Another sunshade umbrella connectable to the back of a chair is taught by Rogers in U.S. Pat. No. '954. The unique arrangement for interconnection to the back of the seat in conjunction with a conventionally configured umbrella provides a simplistic shade structure for a user positioned on the seat.

A collapsible canopy device by Russo in U.S. Pat. No. '286 includes an arcuate telescoping support member positioned at each side margin of a protective canopy utilized, for example, at an outdoor football game. A fold-up umbrella by De Rosa in U.S. Pat. No. '232 teaches an umbrella with a telescoping tubular standard centrally positioning a flexible cover made of panels arranged in a circular pattern. The angle between each radially extending rib or batten is variable so as to regulate the size of the umbrella pattern.

The present invention provides a personal canopy apparatus for protecting an individual from the elements while in a seated or a standing position and offering a uniquely deployable two section canopy which is supported and pivotally extendable in radial or fan-like fashion from the forward distal end of the top spine of the device. By a unique arrangement of pivotal axes, a broad array of protective orientation for the user is achievable.

BRIEF SUMMARY OF THE INVENTION

This invention is directed to a personal canopy apparatus for an individual or individuals which is connectable to a separate structure enabling its use in a variety of applications, including that found in a boat. The canopy apparatus includes a main spine connectable at a lower end thereof to the separate structure, a top spine pivotally connected in a generally laterally extending orientation to an upper end of said main spine and a retractable canopy. The canopy includes two flexible covers each supported along a proximal edge thereof by said top spine. A leading edge support arm and a plurality of battens are supportively connected to each of the covers, support arms and battens pivot connected at a proximal end thereof about one of two closely spaced third pivotal axes to a distal end of the top spine whereby, when each of the covers are open in a fan-like manner, the support arms extend laterally in opposite directions from the top spine to form a leading edge of the canopy with the battens arranged in a spaced apart array radiating from the third pivotal axis. The support arms, covers and battens are stored in closely aligned fashion within a substantially hollow length of said top spine.

It is therefore an object of this invention to provide a personal canopy apparatus offering various levels of comfort and protection which will protect the user in a seated or standing position from the elements of sun, wind and rain or insects without substantially interfering with outdoor activity such as in fishing from a boat.

It is another object of this invention to provide a uniquely configured arrangement of main spine and top spine pivotally connected together and supporting a fan-like deployable canopy section from either one or both sides of the top spine for added versatility. Attachable back, side and front panels offer additional levels of comfort, cover and protection.

Still another object of this invention is to provide a personal canopy which includes attachable side, back and front panels which afford additional levels of comfort, cover and protection.

A unique arrangement of pivotal axes of a personal canopy apparatus of the present invention satisfies yet another object of this invention by greatly expanding the positional versatility and adjustability through multiple pivotal axes between respective spine members and attaching member for greater weather protection.

Another object of the canopy apparatus is to be compact, taking up minimal space when not deployed and portable to be taken off particular separate structure and stored or used in another application by attaching to a different structure.

Still another objective is to minimize the wind resistance to enable use in windy conditions or while moving.

In accordance with these and other objects which will become apparent hereinafter, the instant invention will now be described with reference to the accompanying drawings.

BRIEF DESCRIPTION OF THE SEVERAL VIEWS OF THE DRAWING(S)

Figure 18A:
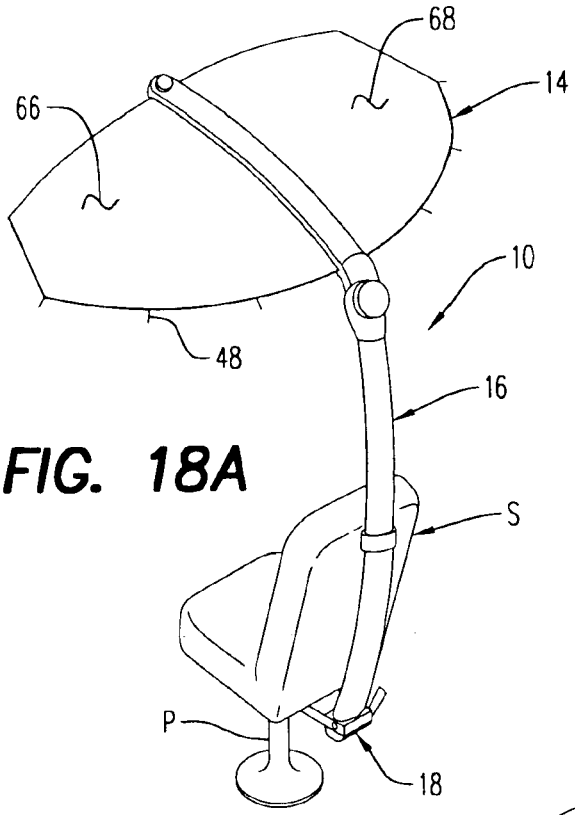
Figure 18B:
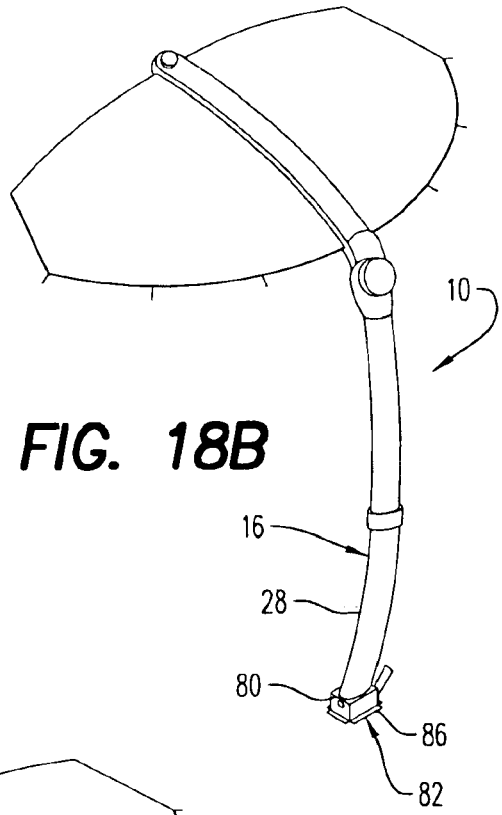
Figure 18C:
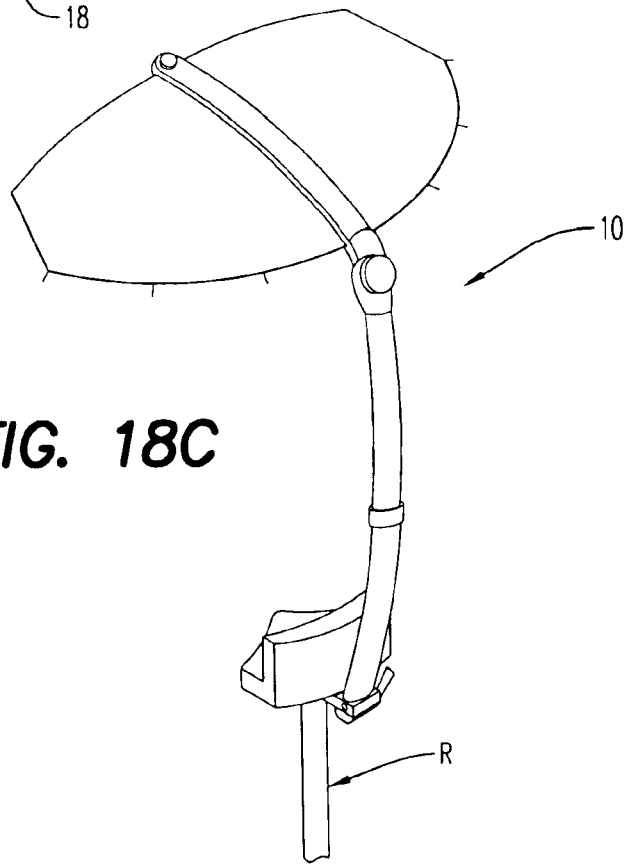

FIGS. 18A, 18B, and 18C depict various modes of attaching the device to a separate support structure.

Figure 19:
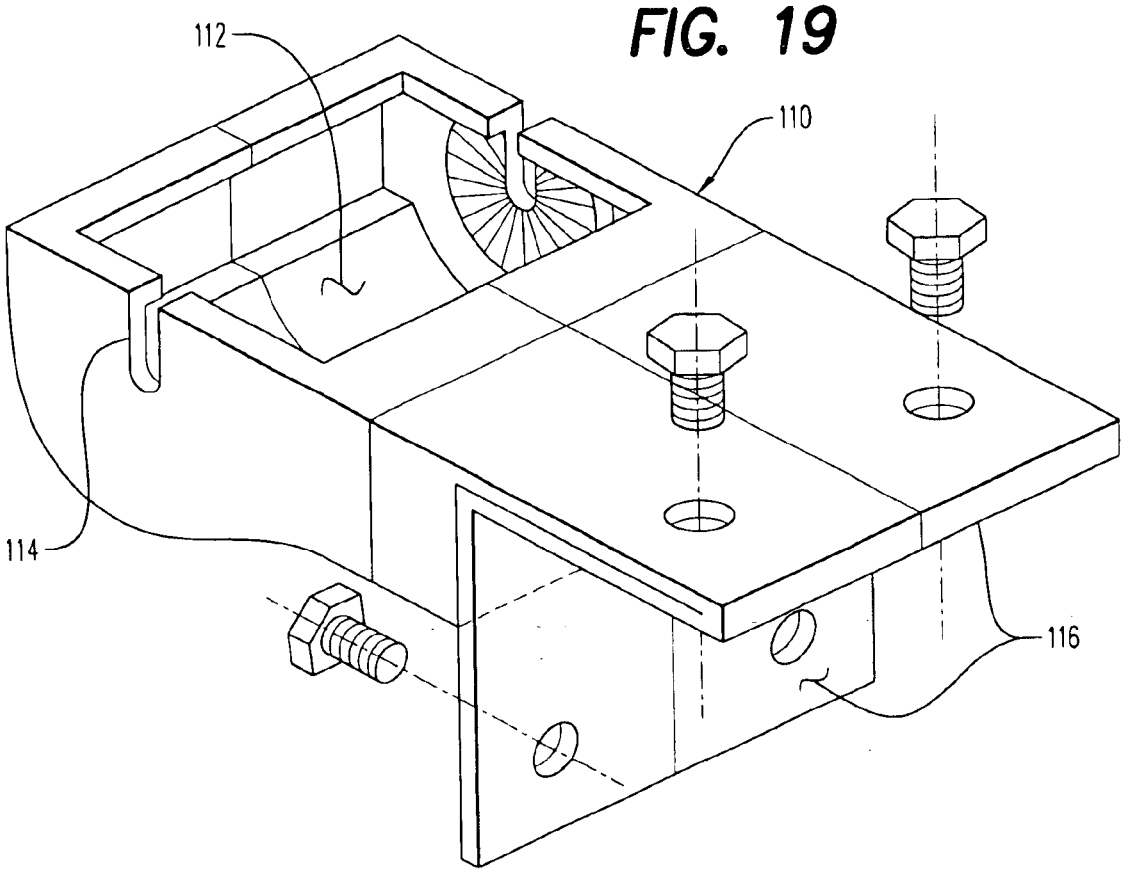

FIG. 19 a perspective view of a lower attaching bracket attachable to a gunnel bench seat, console of a boat, pedestal boat seat, railing or other types of structures of a boat.

Figure 20:
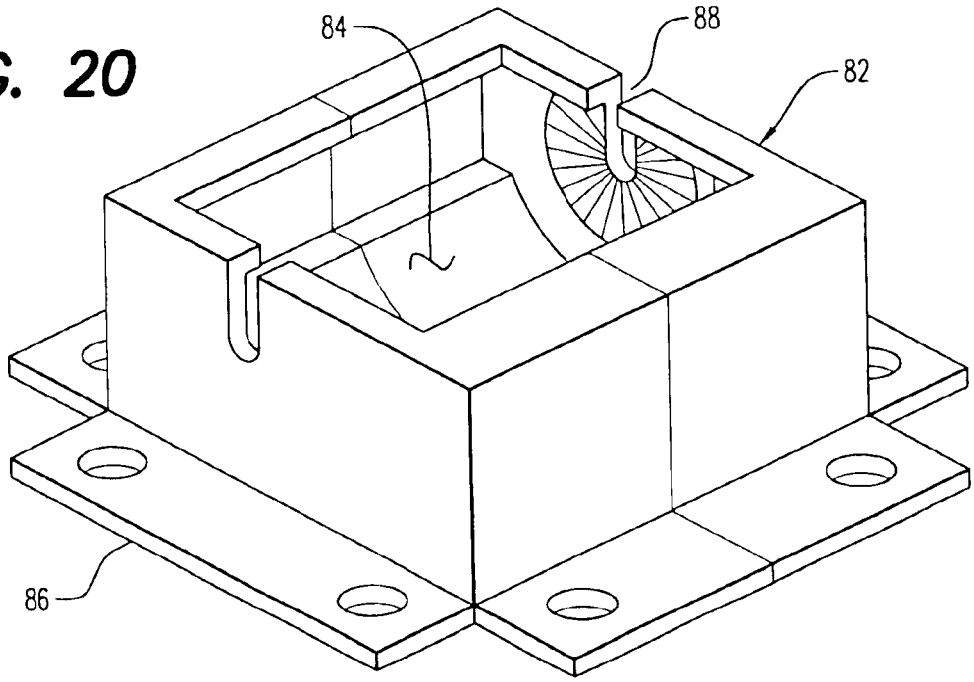

FIG. 20 is an enlarged perspective view of the floor attachment of FIG. 18B.

Figure 21:
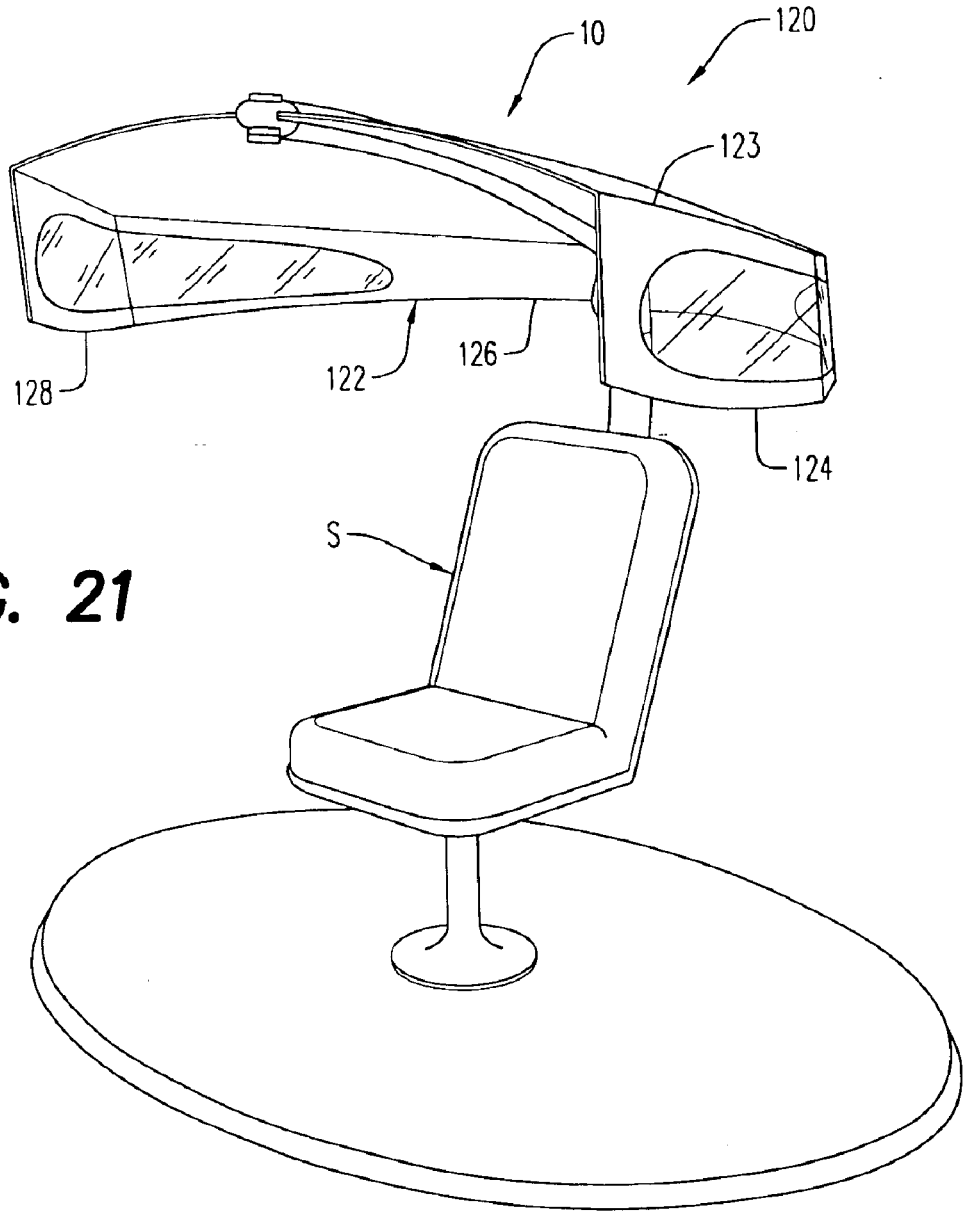

FIG. 21 is a perspective view of another embodiment of the invention.

Figure 22:
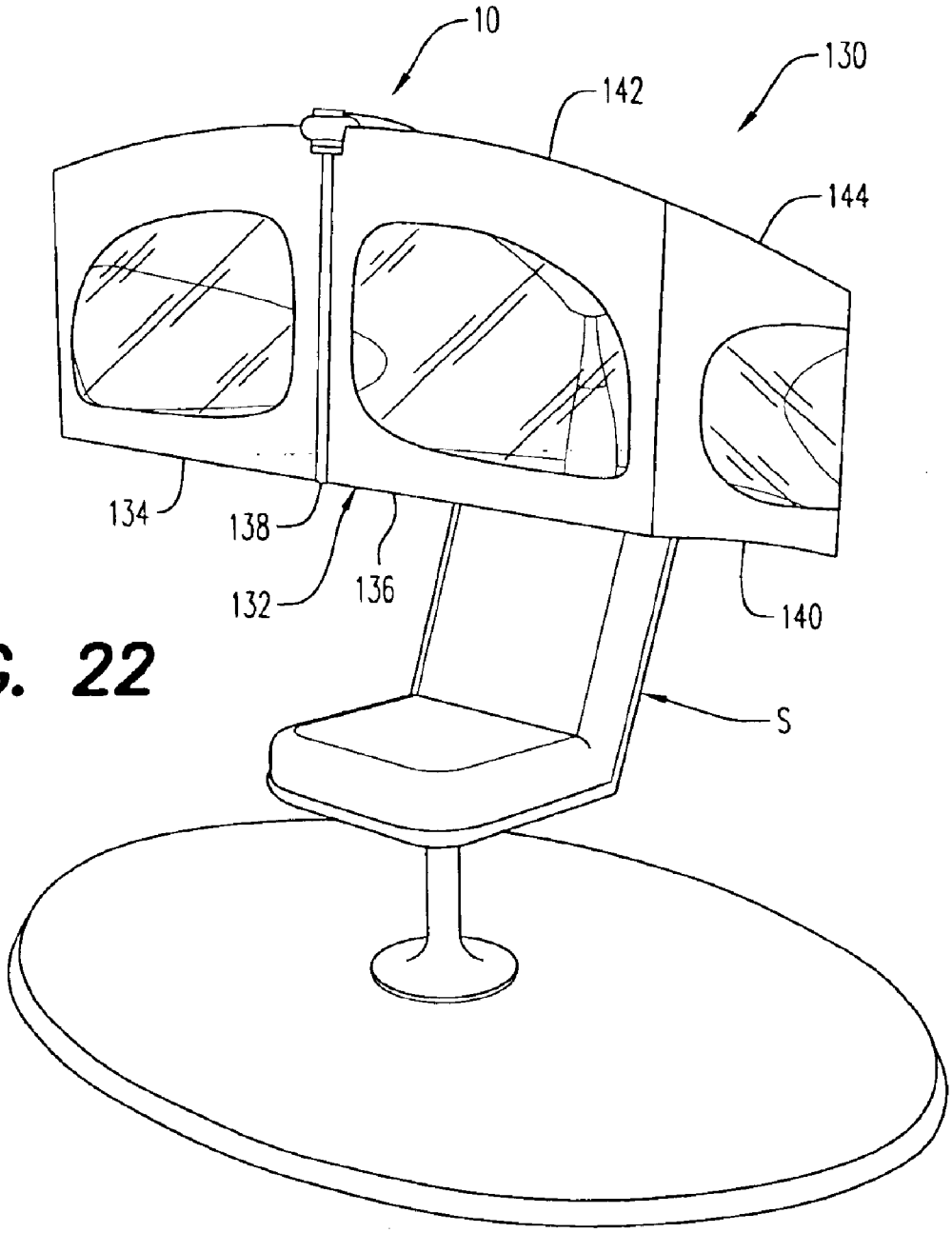

FIG. 22 is a perspective view of still another embodiment of the invention.

Figure 23:
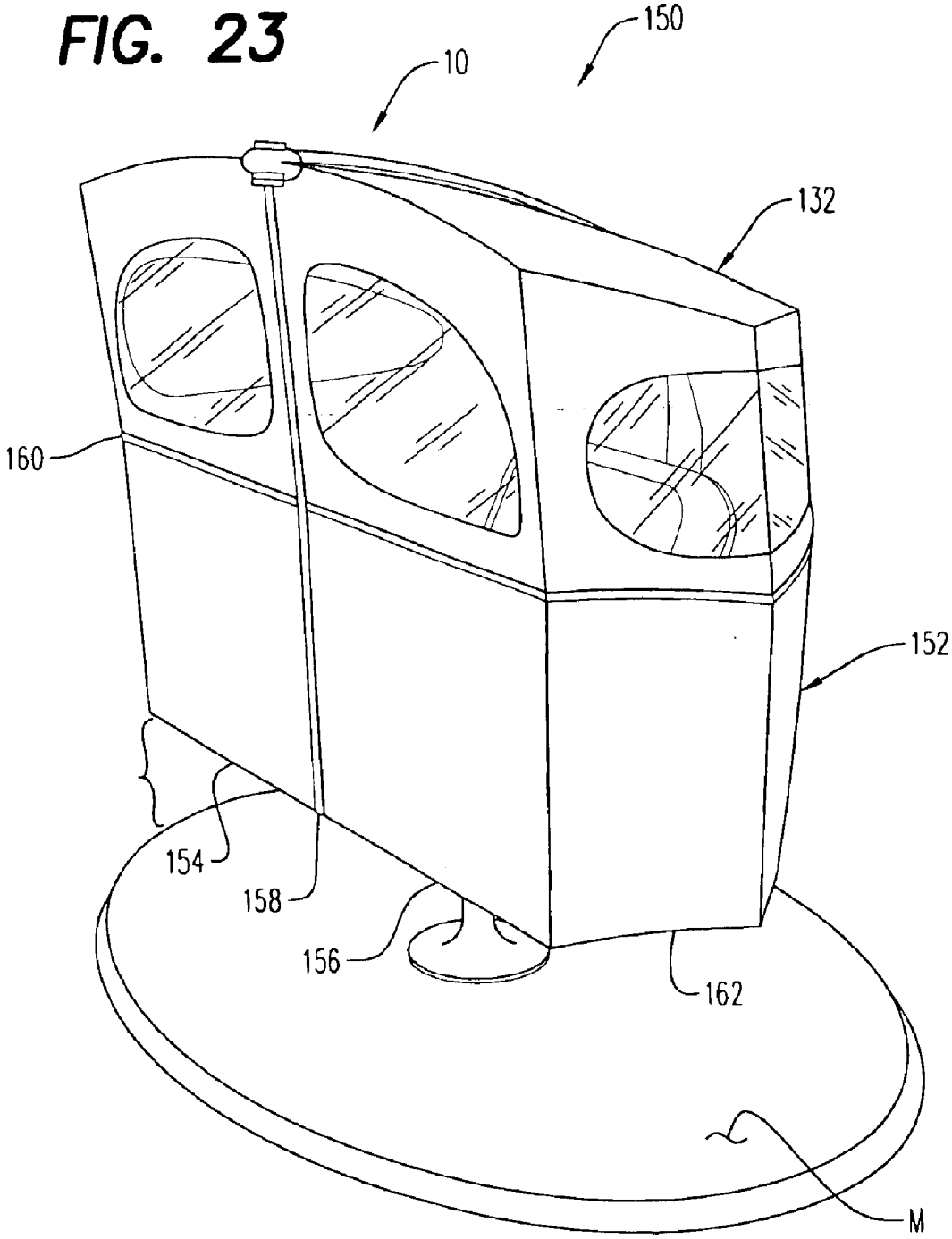

FIG. 23 is a perspective view of yet another embodiment of the invention.

Figure 24:
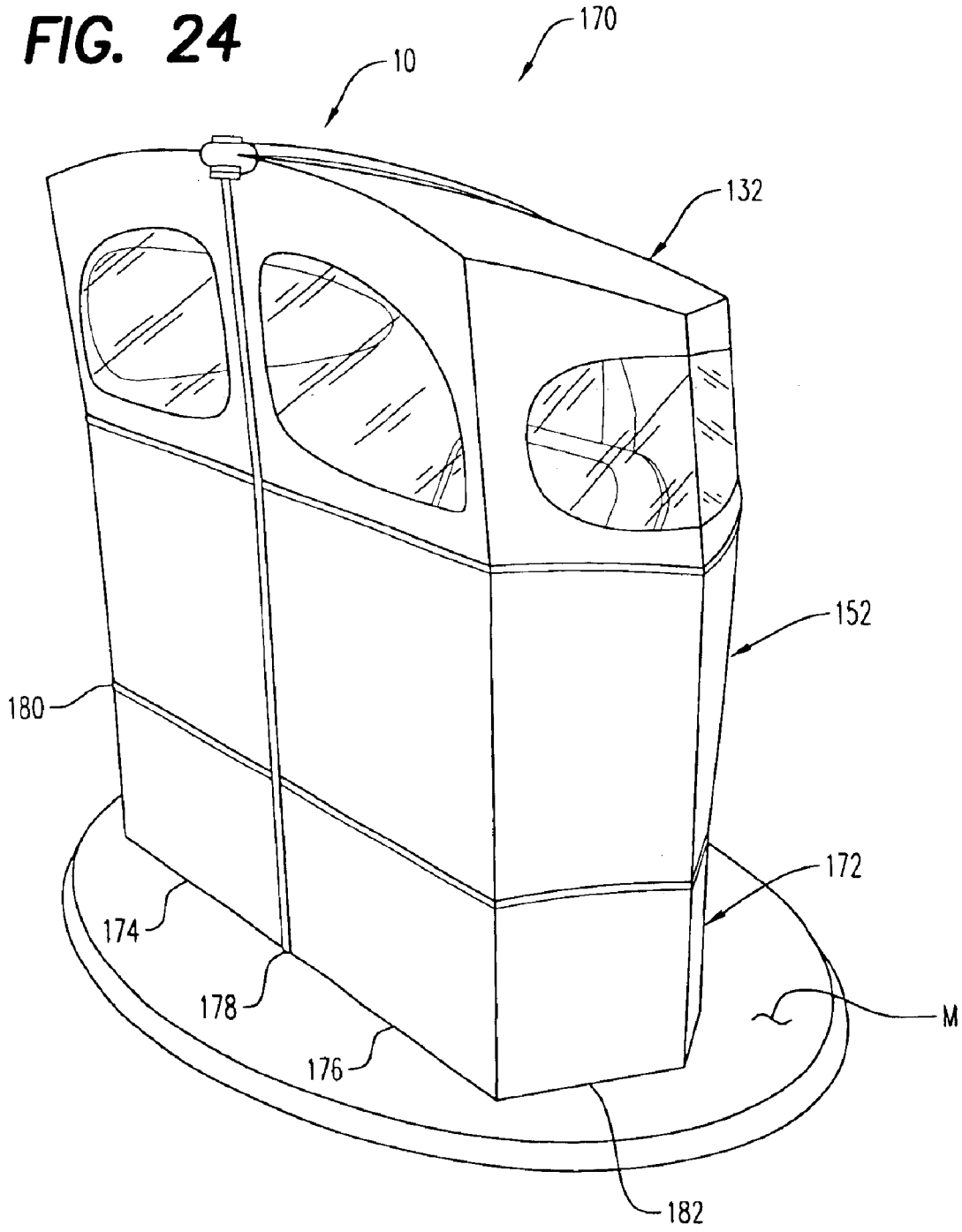

FIG. 24 is a perspective view of another embodiment of the invention.

DETAILED DESCRIPTION OF THE INVENTION

Referring now to the drawings, and particularly to FIGS. 1 to 5, a preferred embodiment of the invention is there shown generally at numeral 10. This personal canopy apparatus 10 which, in this case, is sized for use by an individual but may also be up-scaled for two or more individuals and includes an elongated rigid top spine 12, an elongated rigid upright spine 16 and a canopy 14. The upright or main spine 16 is formed of two telescoping members 26 and 28 which facilitate vertical telescopic height positioning of the canopy 14 and top spine 12 as will be described herebelow.

The lower main spine member 28 is pivotally releasably attached along axis 76 to the base of a swivel seat S by a universal mount 18 which is attachable to the upper pedestal support P of the boat seat S having a back B and a seating panel or support C. The upper end portion of the main spine 16 is interconnected to a proximal end of the top spine 12 by a pivotal tilt connection arrangement 22. This tilt connection 22 has a pivotal axis 74 which is oriented at an acute angle to the main spine 16 and the top spine 12.

Figure 8:
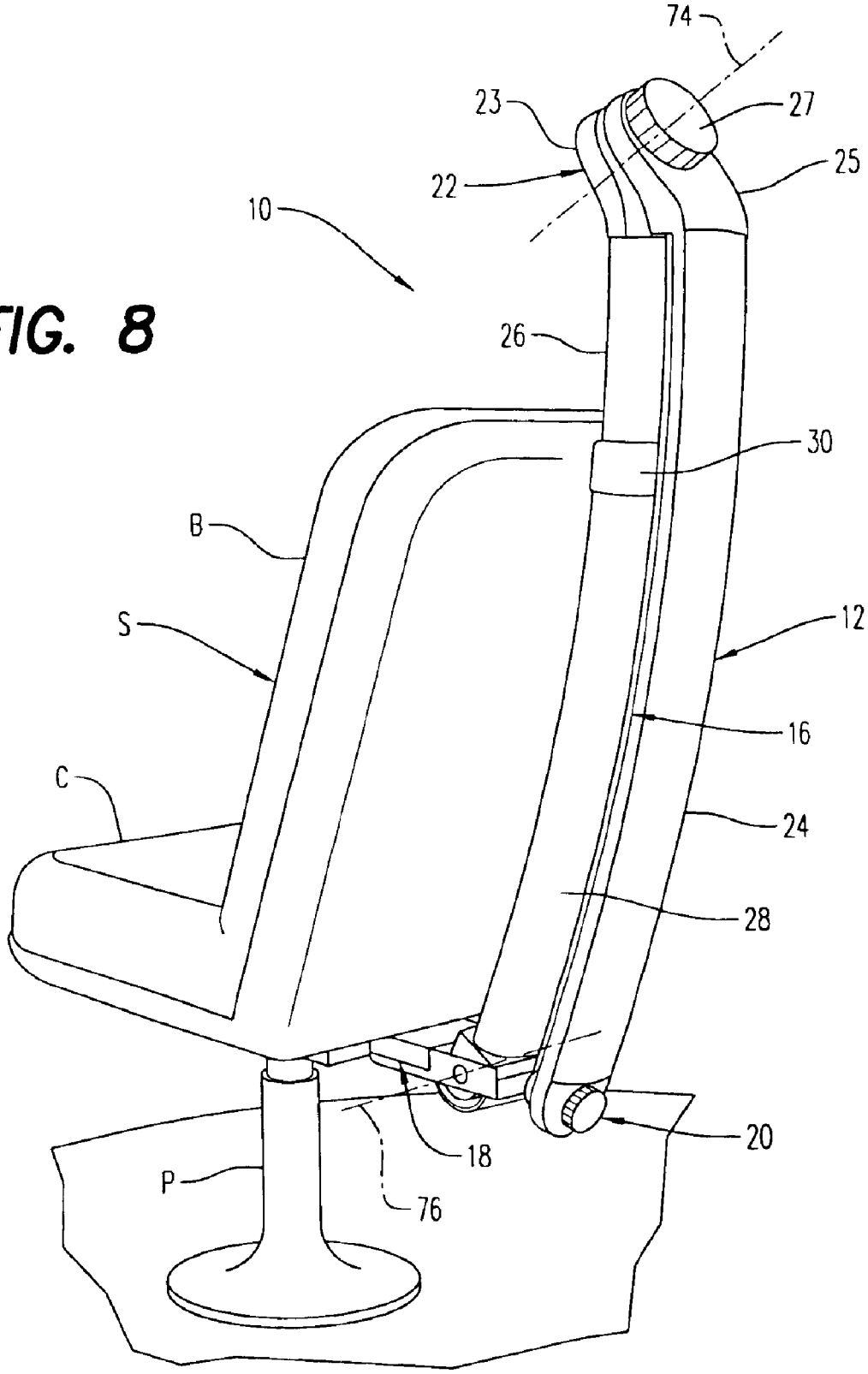
FIG. 8 is a rear perspective view of the invention of FIG. 1 with the canopy fully stored in the top spine which is in a folded non-use position against the main spine.

As best seen in FIG. 8, the tilt connection 22 includes mating connector halves 23 and 25 connected together at the proximal ends of the upper member 26 and the top member 24 of the main spine 16 and top spine 12, respectively. A tensioning knob 27 provides loosening of this pivotal joint 22 for the angular adjustment of the top spine 12 about the axis 74 which is then resecured by tightening the knob 27. Features of this tilt connection 22 will be described in more detail herebelow.

Figure 1:
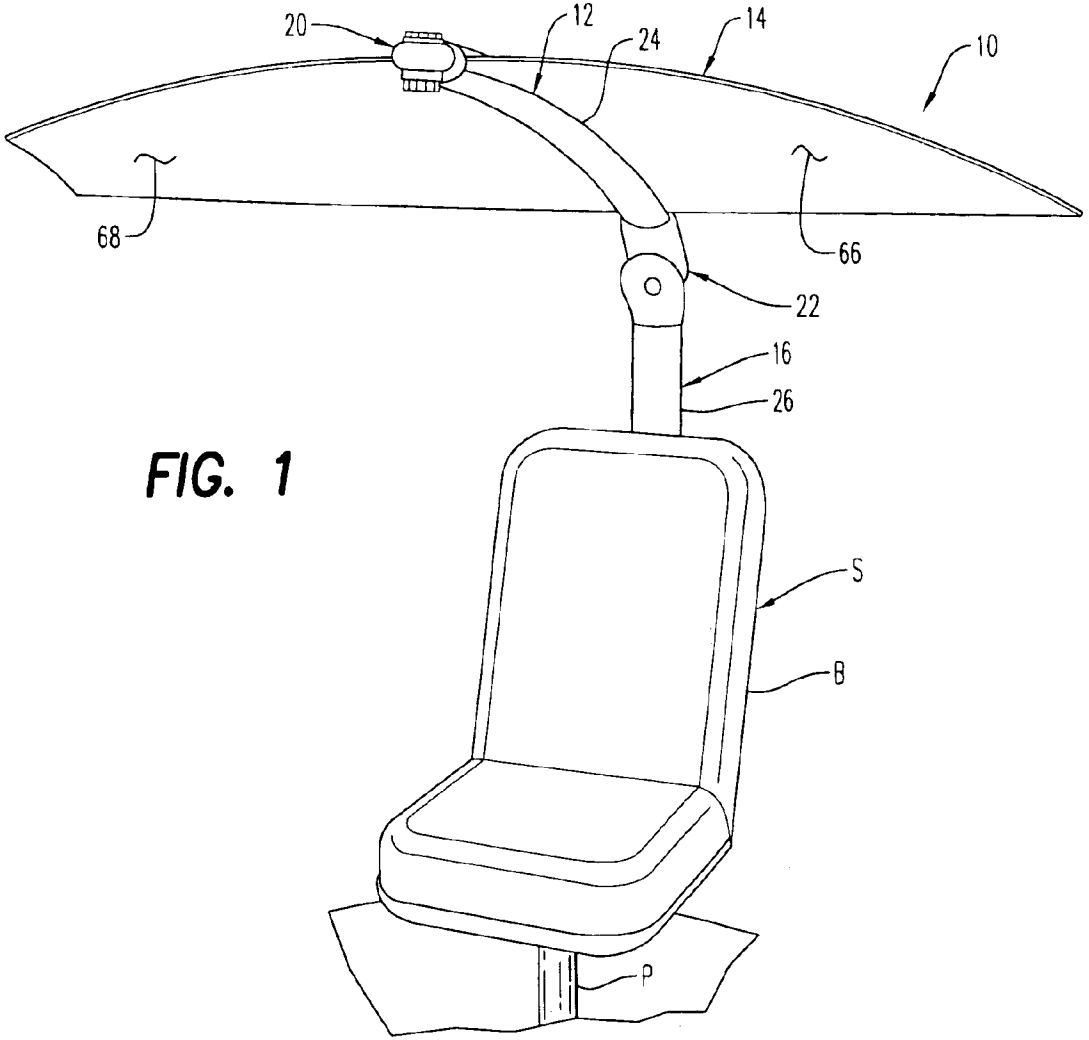
FIG. 1 is a front perspective view of the invention in its deployed in-use position.
Figure 2:
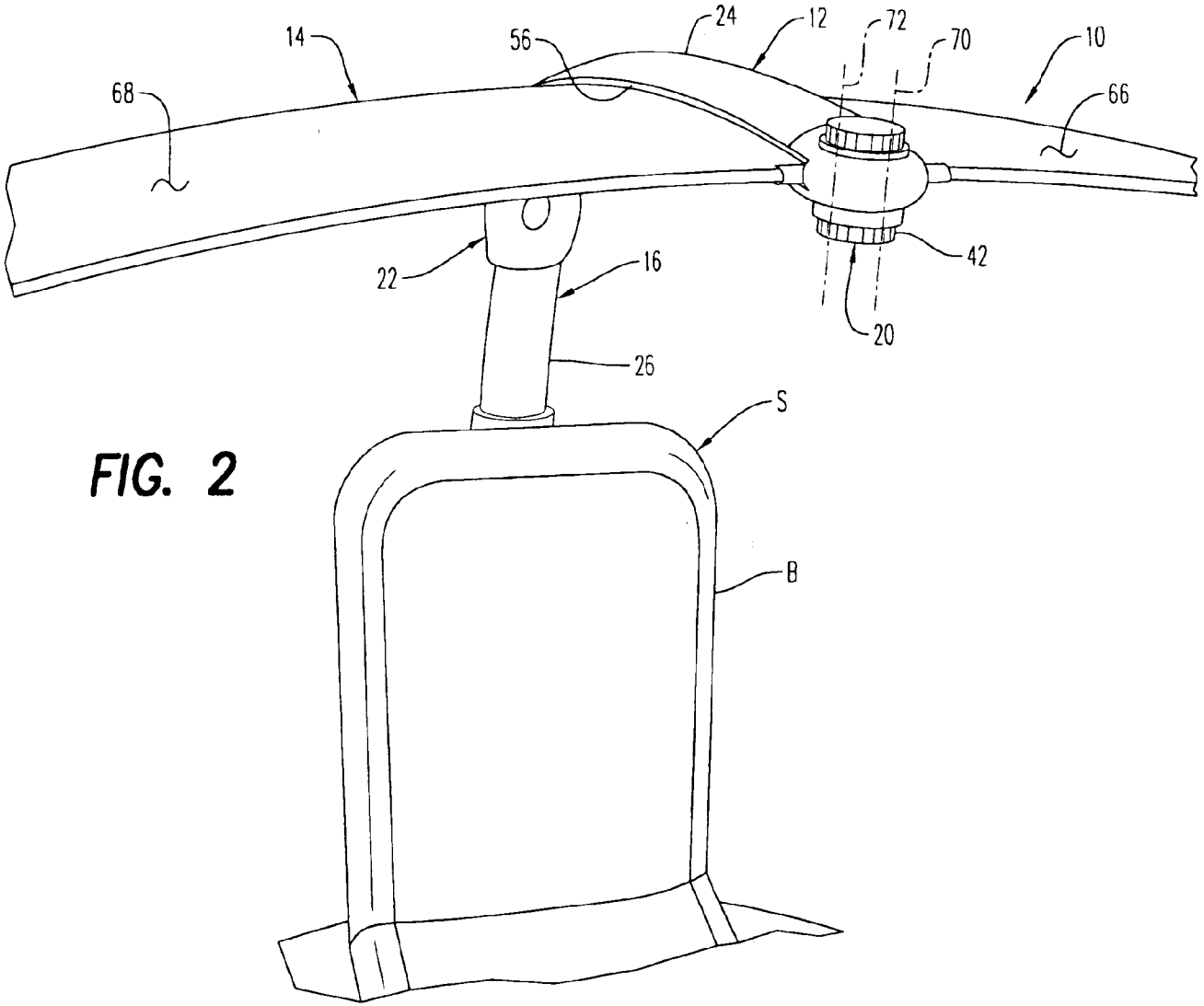
FIG. 2 is another front perspective view of the invention shown in FIG. 1.
Figure 3:
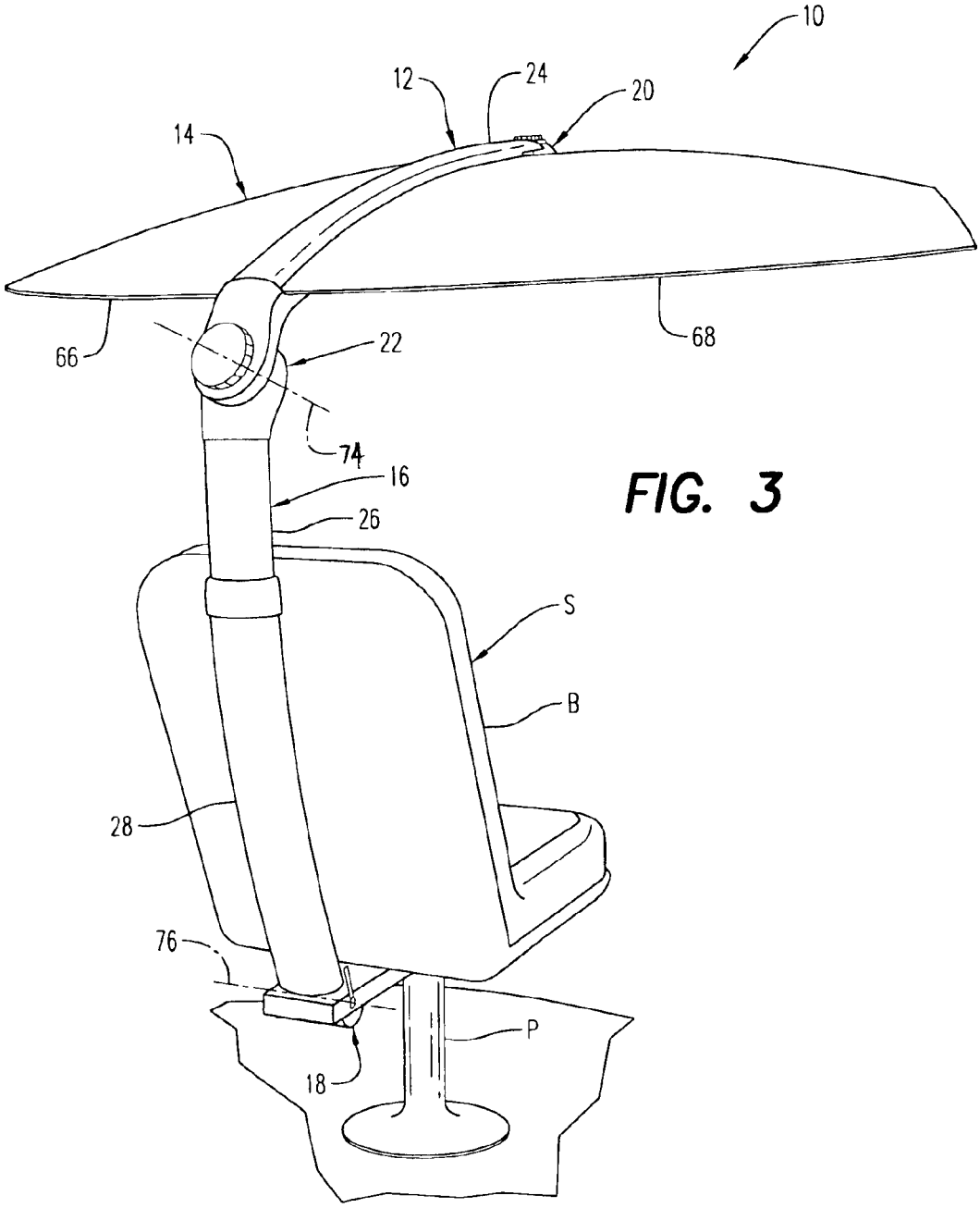
FIG. 3 is a rear perspective view of the invention of FIG. 1.
Figure 4:
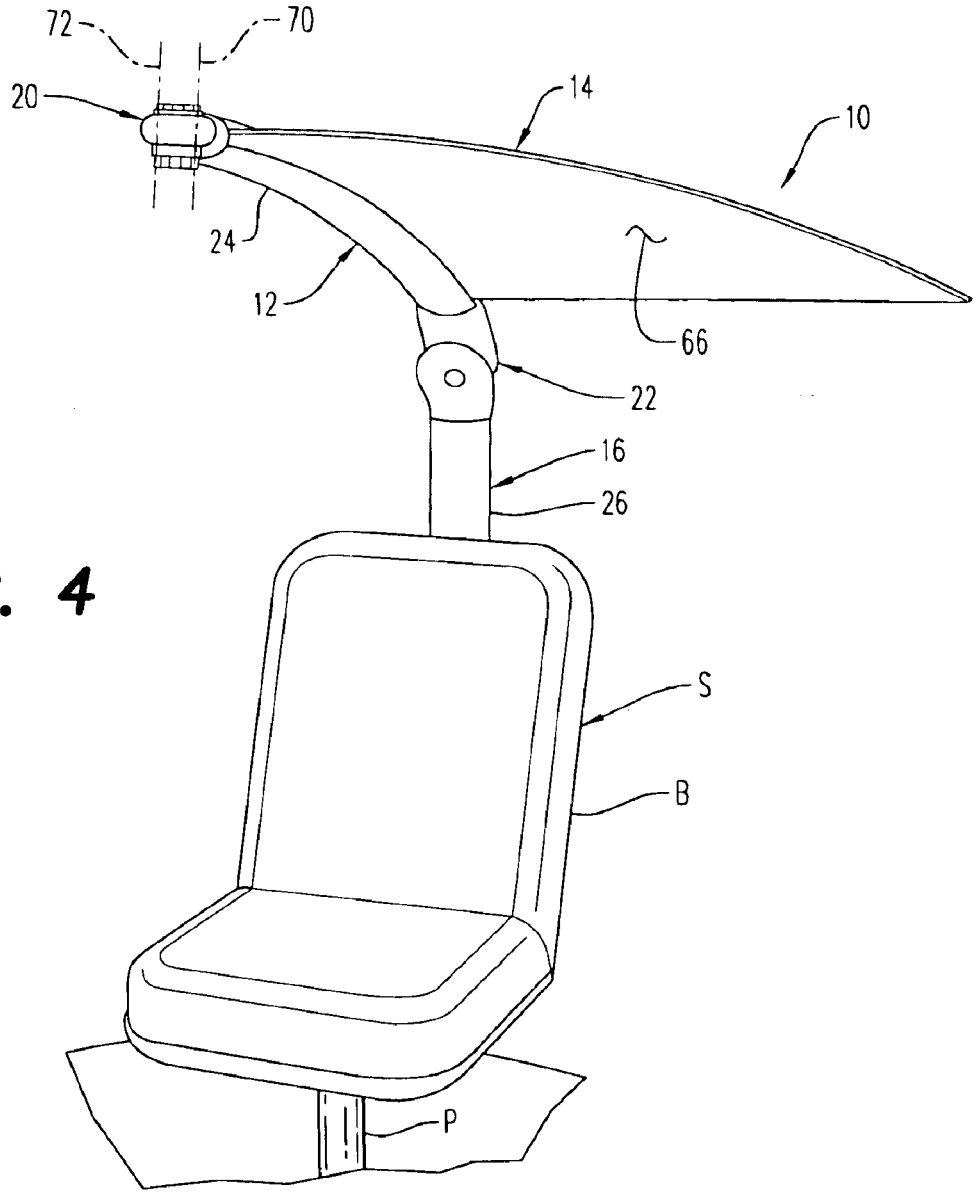
FIG. 4 is still another front perspective view of the invention of FIG. 1 wherein only one half of the retractable canopy is in the in-use position.
Figure 10:
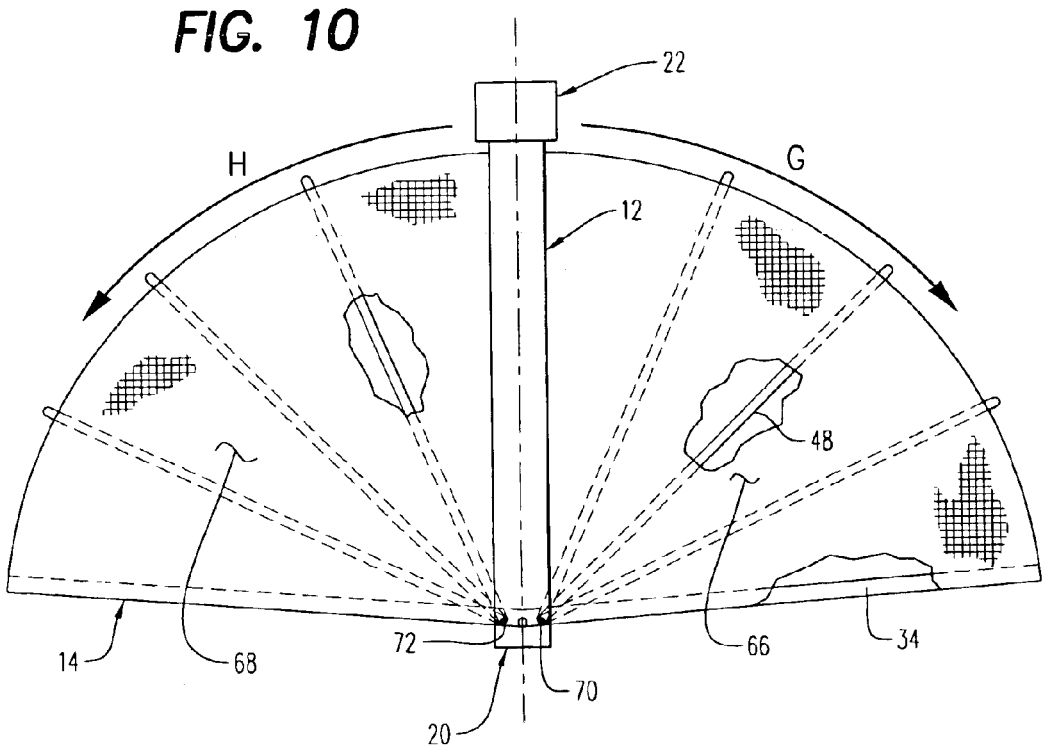
FIG. 10 is a top plan schematic view of the canopy and top spine of the invention.

In this preferred embodiment 10, the top spine 12 extends, when adjusted about axis 76 of the main spine 16 as shown, generally forwardly from the tilt connection 22. The forward or distal end of the top spine 12 terminates in a canopy support mechanism 20. The retractable canopy 14 is comprised of two flexible water tight or water resistant covers 66 and 68 which are deployable and retractable about pivotal axes 70 and 72 as seen in FIGS. 2 and 4 and described in more detail as best seen in FIG. 10. Each of the flexible covers 66 and 68 are supported at a leading edge thereof by a leading edge support arm 34 each of which is pivotally connected at a proximal end thereof to the respective pivotal axis 70 or 72. A plurality of evenly spaced battens 48, each sewn into or concealed within covering layer portions of each of the covers 66 and 68, are also pivotally connected at a proximal end thereof about axes 70 and 72 and radiate outwardly therefrom in fan-like fashion as each of the flexible covers 66 and 68 are opened in the direction of arrows G and H, respectively.

Figure 5:
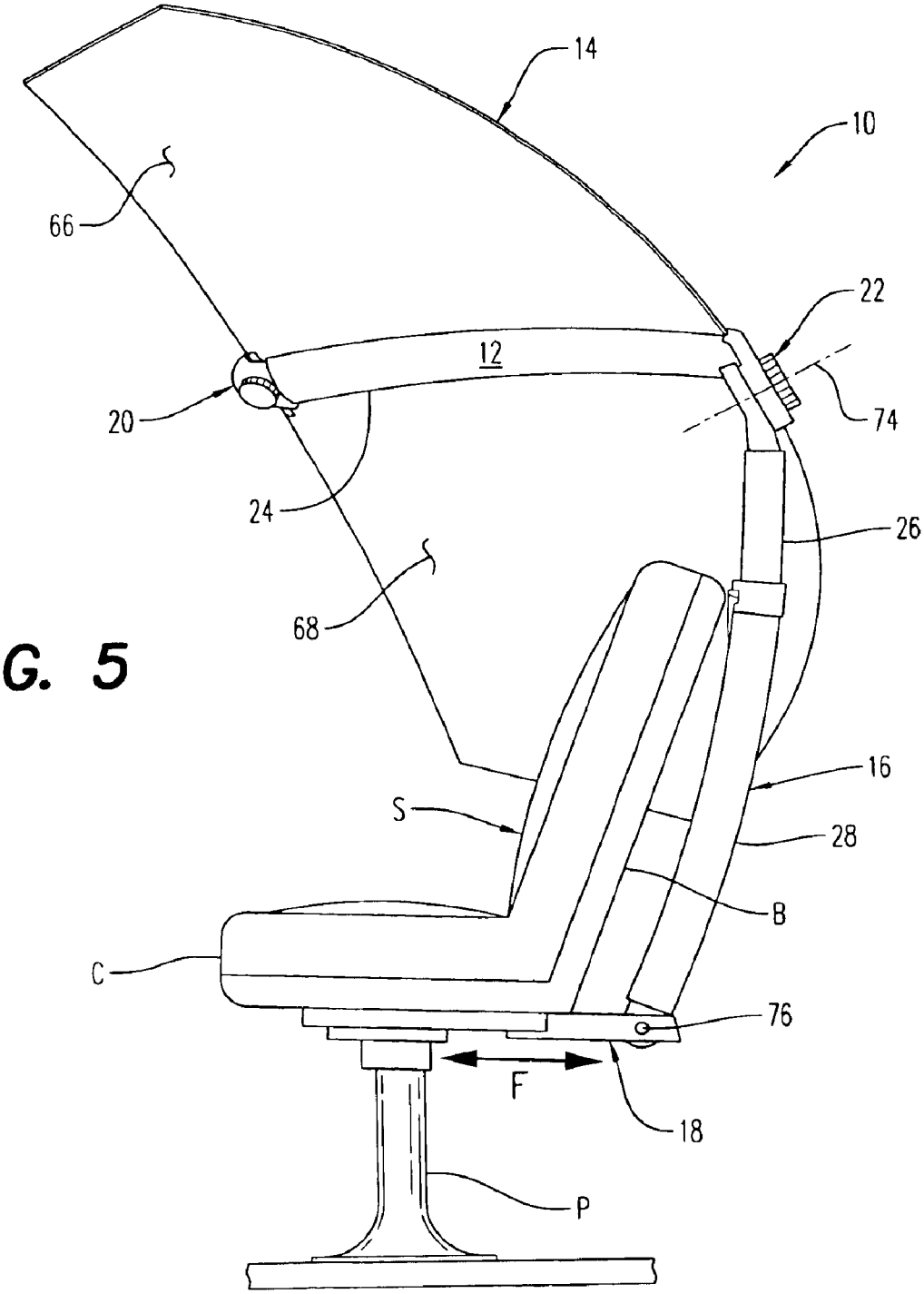
FIG. 5 is a side elevation view of the invention of FIG. 1 showing the canopy in a tilted position.

As seen in FIG. 4, only one of the flexible covers 66 in this case or 68, may be separately deployed with the other flexible cover 68 held in a stored configuration within the top spine member 24 as will be described herebelow. Moreover, as seen in FIG. 5, the entire canopy 14 may be oriented to one side or the other as pivotally adjusted about pivotal axis 74 where wind or sun protection from that direction is desired.

Figures 6A, 6B, 7:
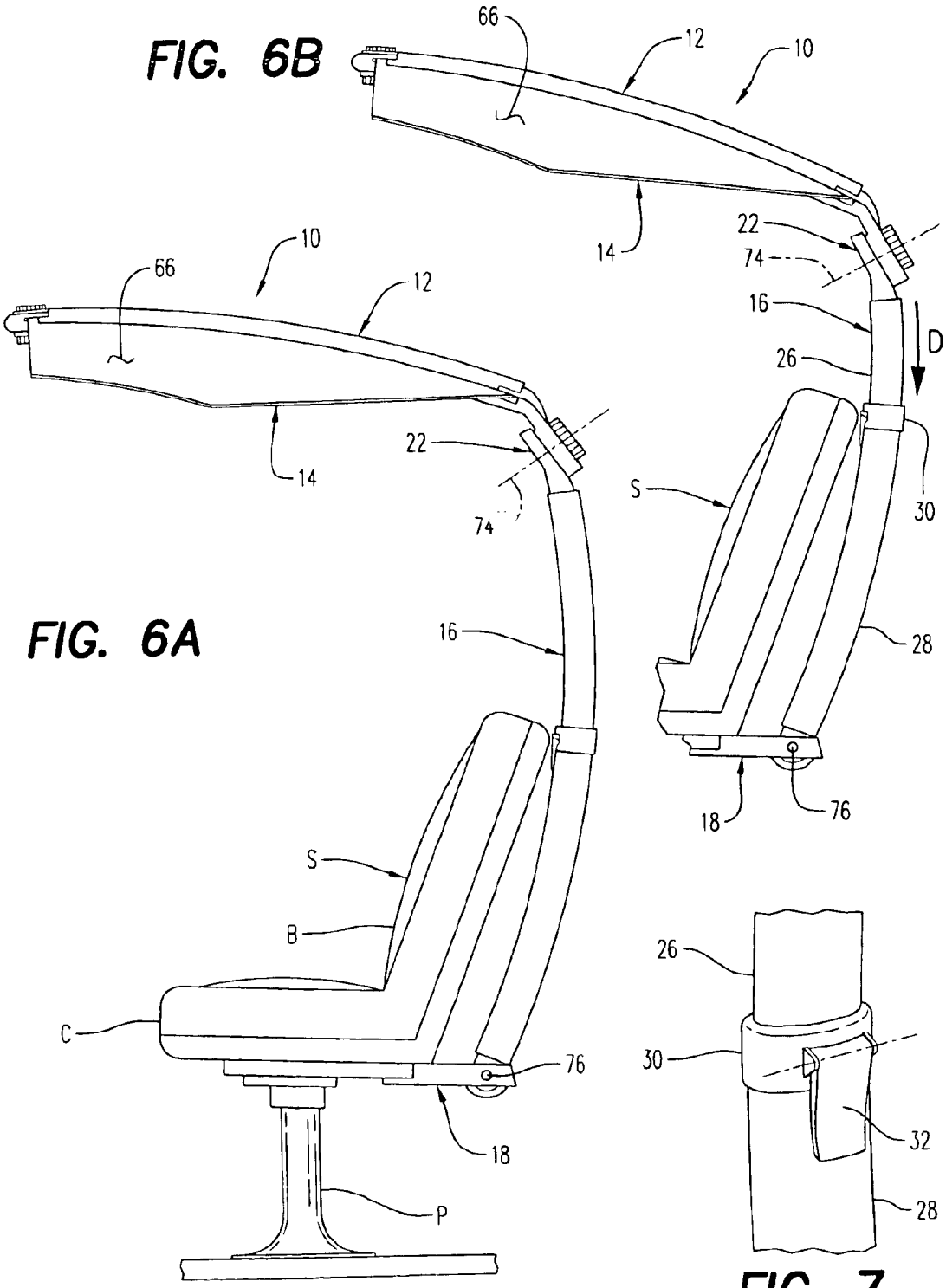
FIG. 6A is a side elevation view of the invention of FIG. 1 in an extended height position of the canopy.
FIG. 6B is a view similar to FIG. 6A showing the canopy in a more lowered retracted position.
FIG. 7 is a perspective view of the locking arrangement associated with the upright main spine of the invention.

As seen in FIGS. 6A and 6B, the telescoping features of the upright spine 14 are there shown wherein the upper spine member 26 may be moved downwardly in the direction of arrow D and then resecured by locking collar 30 by locking handle 32 as seen in FIG. 7 to secure the desired telescopic relationship. By this arrangement, the height of the canopy 14 and top spine 12 are easily adjustable vertically without sacrificing protective overhang forwardly of the user seated in the swivel boat seat S.

Figure 9:
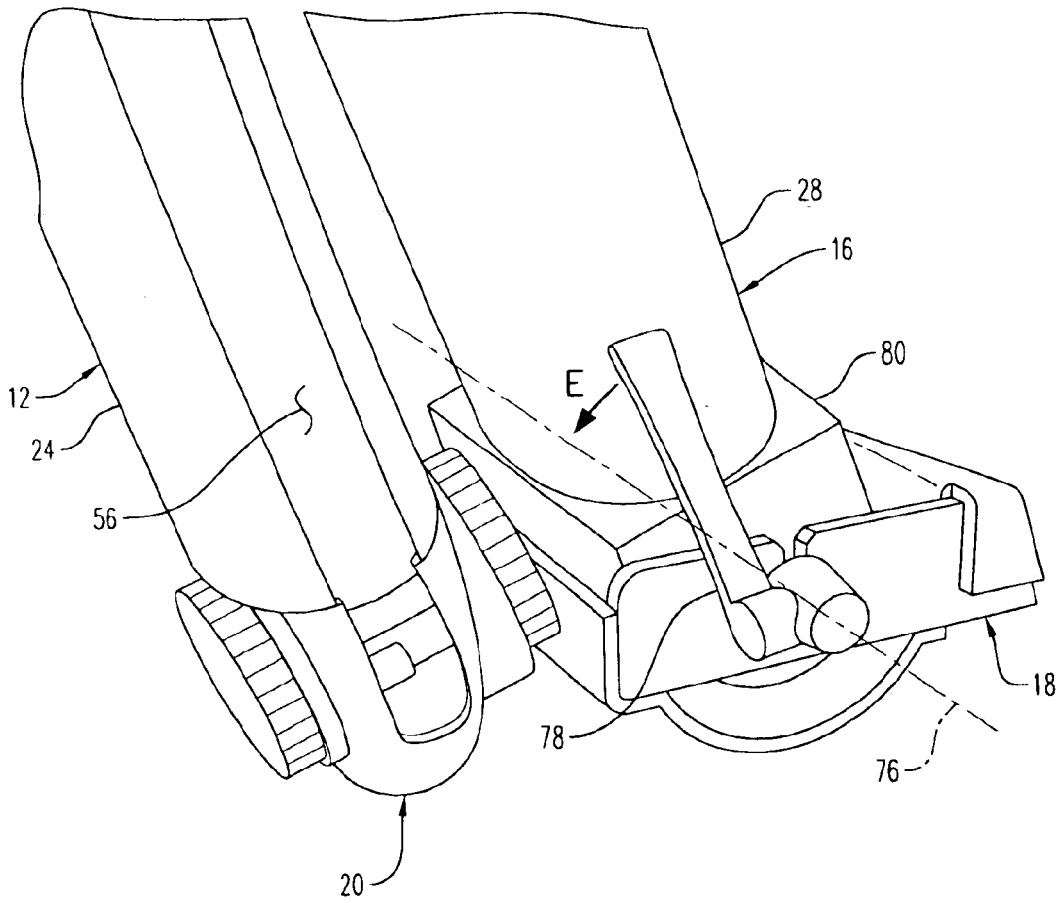
FIG. 9 is an enlarged perspective view of a lower portion of the main and top spine of FIG. 8.

In FIGS. 8 and 9, the canopy 14 has been stored within the top spine 12 in a manner described herebelow and pivotally connected about axis 74 into a stored position generally alongside of the main spine 26 and there locked in place by the suitable tensioning of knob 27.

As will be more fully appreciated at this point in the description of the present invention, there are substantial benefits to forming each of the main and top spines 16 and 12, respectively into the arcuate configuration shown. The clearance with the back B of the swivel seat S by this arcuate configuration allows the main spine mount 18 to be shorter and thus closer to the base of pedestal P, additional head clearance is provided beneath the arched configuration of the center of top spine 12 and the unique side protection offered as shown in FIG. 5 when the entire canopy 14 is pivoted about axis 74 is easily achievable.

Canopy and Canopy Support

Figure 14:
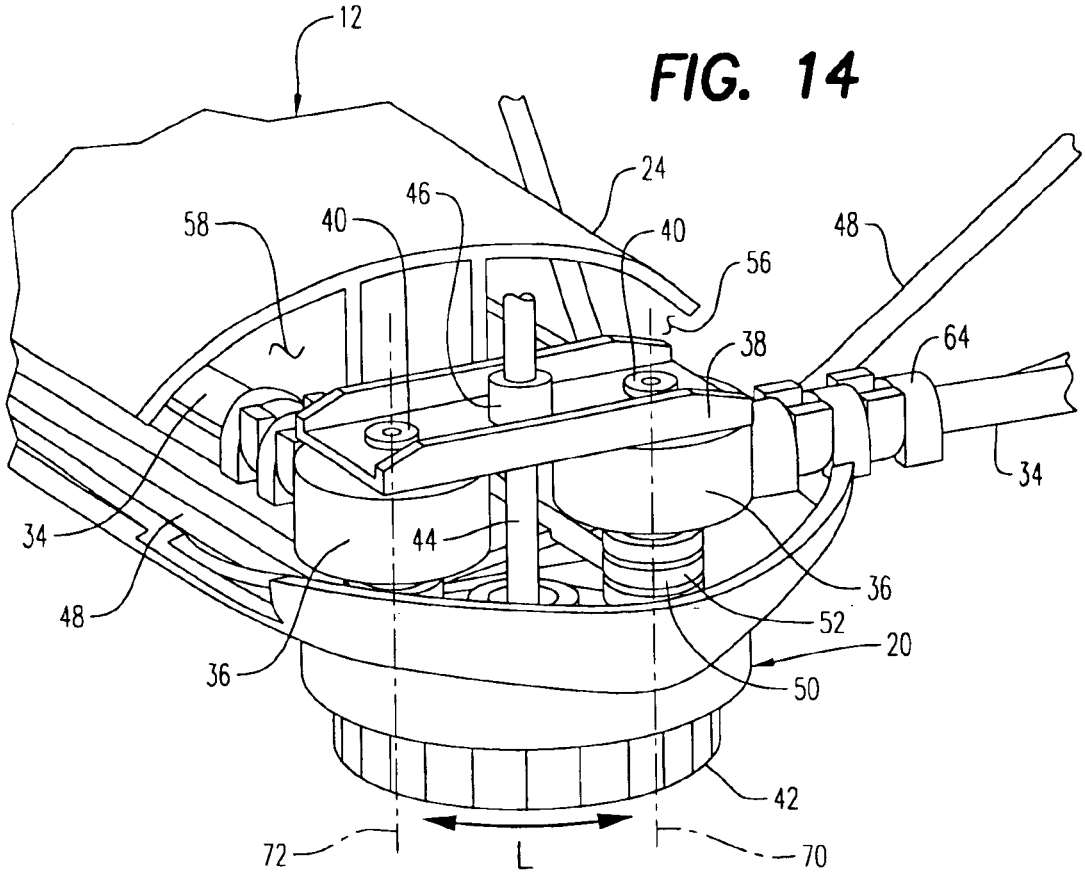
FIG. 14 is an enlarged perspective view of the distal end portion of the top spine of the invention with the top end cover removed for clarity.
Figure 15:
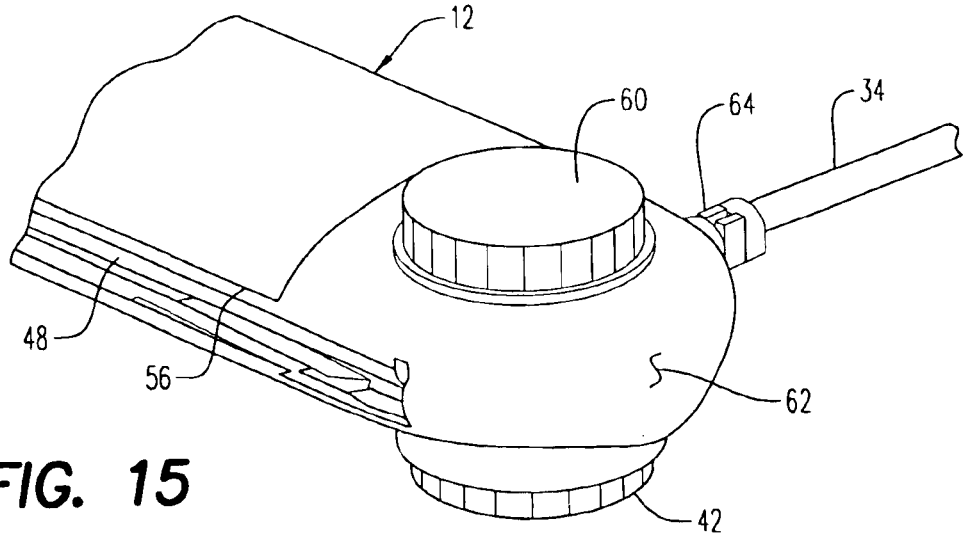
FIG. 15 is a view similar to FIG. 14 with the top end cover and upper tensioning knob in place.
Figure 16:
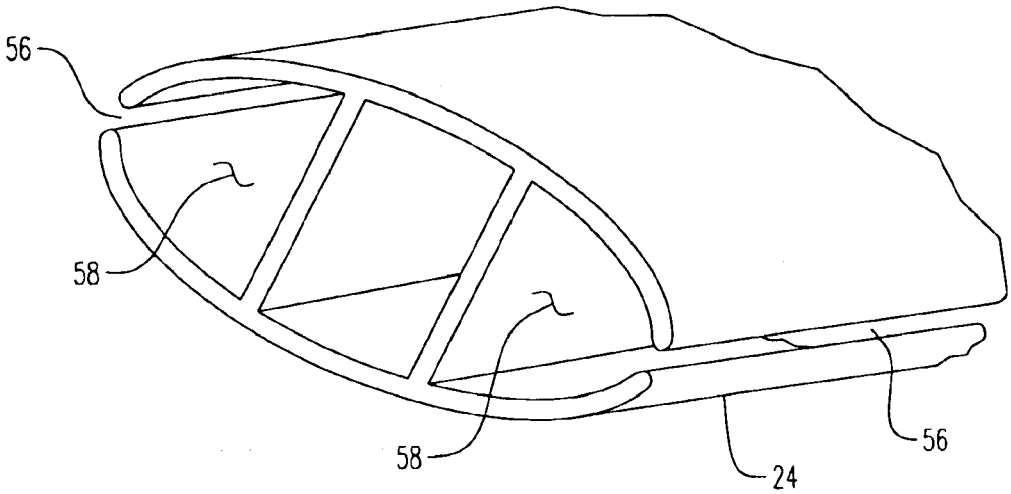
FIG. 16 is a perspective view of the distal end portion of the top spine channel member.

Referring now to FIGS. 14 to 17, the details of the canopy support assembly 20 and canopy storage arrangement within the top spine member 24 of the top spine 12 are there shown. As best seen in FIGS. 14 and 16, the elongated top spine member 24, generally formed by metal or plastic extrusion, includes upright strengthening webs extending centrally therealong and storage cavities 58 which are accessible by side access slots 56 formed along either side portion of this elongated oval shaped section configuration. Each rigid leading edge support arm 34, interconnected by a plastic molded coupling 64 of a mounting boss 36 or 36', is mounted about one of the pivotal axis 70 or 72. A support shaft 40 in alignment with each of the pivotal axes 70 and 72 provide the support for rotation only of each of the mounting bosses 36 and support arms 34.

Variable tensioning of the pivoting movement effort of each of the leading edge support arms 34 in the direction of arrows G and H in FIG. 10 is regulated by the tensioning produced by rotation of tensioning knobs 42 and 60 in the direction of arrow L. The elongated threaded fastener 44 acting on threaded boss 46 against a tensioning plate 38 urges each of the mounting bosses 36 against a compression spring 53 and spacer 54 shown in FIG. 17.

Figure 17:
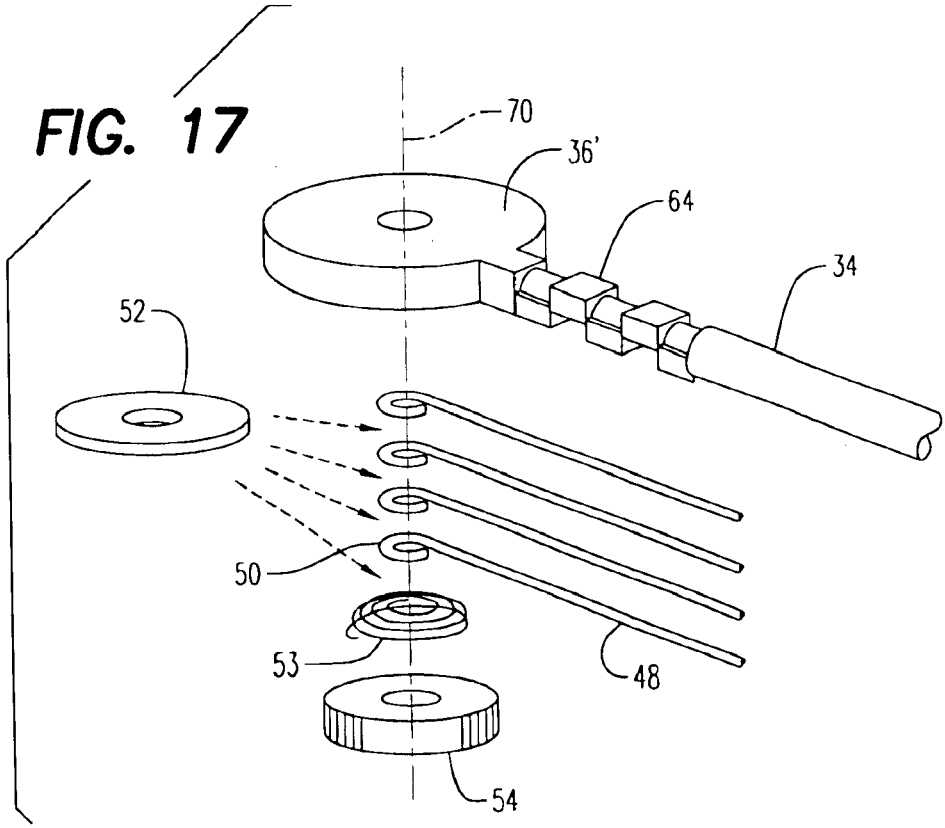
FIG. 17 is an exploded view of the pivotal attachment of the leading edge support arm and radially extending battens about one of the pivotal axes positioned at the distal end portion of the main spine.

Each of the battens 48 are also mounted about the corresponding pivot shaft 40 and are pivotal about the corresponding pivotal axes 70 or 72. The proximal end 50 of each batten 48 is looped as best seen in FIG. 17 and mounted between the mounting boss 36 and the spacer 54. Again, by tensioning knobs 42 and 60, the compressive force exerted on the mounting boss 36 and the looped proximal ends 50 of each of the battens 48 regulate the ease with which each of the canopy portions is deployable and storable.

As best seen in FIGS. 14 and 15, the storage cavities 58 accessible via longitudinal slots 56 provide for the easy storage of the battens 48, cover 66 or 68 (not shown for clarity) and leading edge support arm 34 of each canopy half. Likewise, deployment is effected by simply pivotally moving the leading edge support arm 34 out from the cavity 58 through the corresponding longitudinal access slot 56 as seen in FIG. 14. Once each of the leading edge support arms 34 are individually fully deployed in the direction of arrows G and H in FIG. 10 to fully tension each of the flexible covers 66 and 68, respectively, the mating tensioning knobs 42 and 60 best seen in FIG. 15 are then utilized to provide adequate tension to hold the leading edge support arms 34 in the forwardly deployed position.

Figure 11:
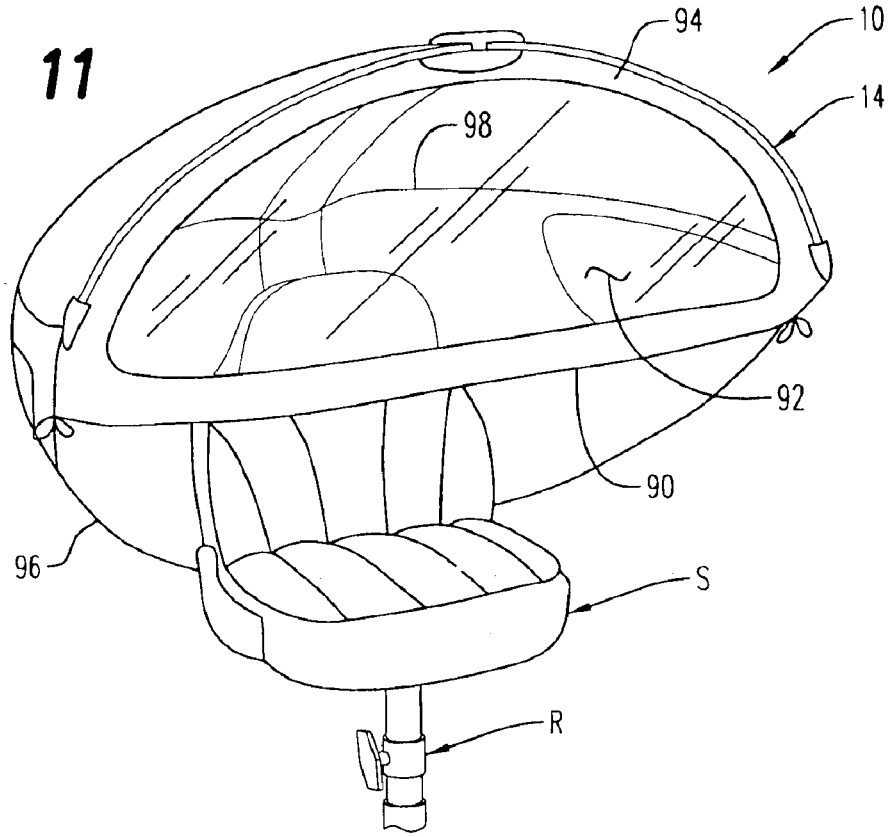
FIG. 11 is a perspective view of another embodiment of the invention.
Figure 12:
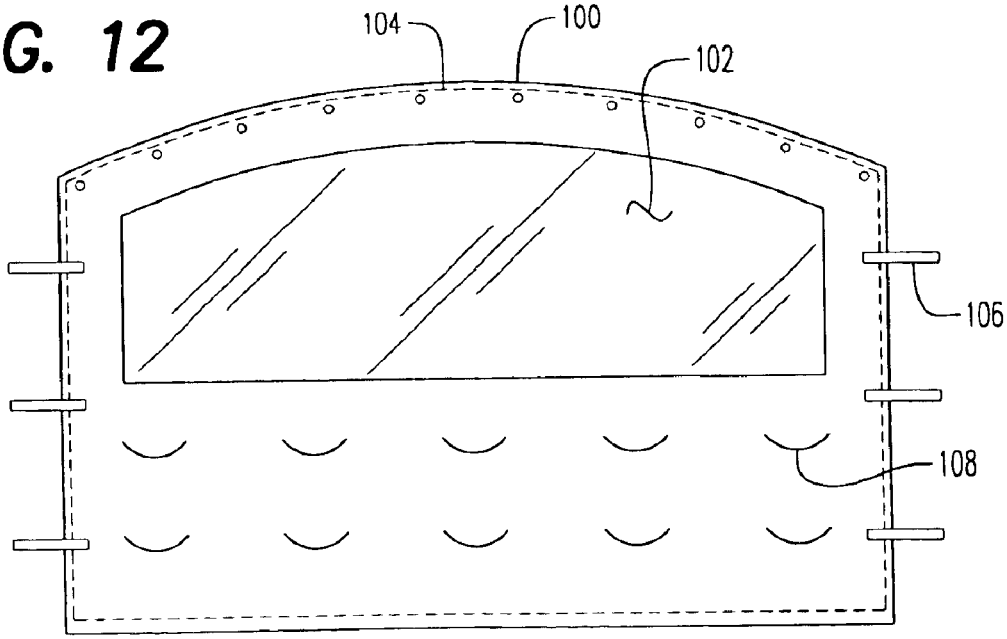
FIG. 12 is a front elevation view of an upright partially transparent protective front panel attachable to the apparatus of FIG. 1 and FIG. 11.

Referring now to FIGS. 11 to 13, various additional panel options and apparatus positioning are there described. In FIGS. 11 and 12, two alternate embodiments of a front screen positionable in front of the user for wind and sun protection are there shown at 90 and 100, respectively. In FIG. 11, the front screen 99, which attaches along the leading edge of canopy 14 as by zipper or VELCRO along 94, includes a large flexible transparent area 92. The front screen 100 in FIG. 12 also includes a zipper 104 for attachment to the leading edge of the canopy and tie straps 106 (or zippers or VELCRO) which facilitate attachment to a lower rear panel 96 which is separately attached to the rearward margin of the canopy 14. Wind slits 108 formed as arcuate cuts in the lower portion of this front panel 100 reduce wind load while also maintaining reasonable protection against driving rain.

Figure 13A:
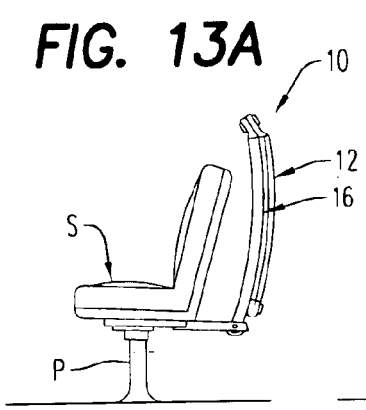
FIGS. 13A to 13E depict side elevation views of various configurations of use of the invention.
Figure 13B:
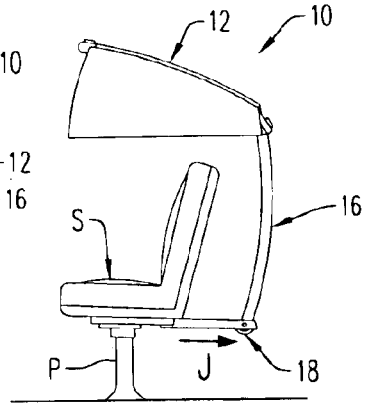

In FIGS. 13A to 13E, various positions and protective panel accessories are there shown. In FIG. 13A, the invention 10 is shown in its stored position with the top spine 12 in the stored position adjacent to the main spine 16 as previously described. In FIG. 13B, the entire apparatus 10 is moved rearwardly in the direction of arrow J by mount assembly 18 with respect to pedestal P of swivel seat S.

Figure 13C:
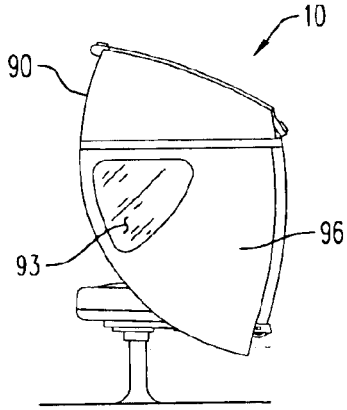
Figure 13D:
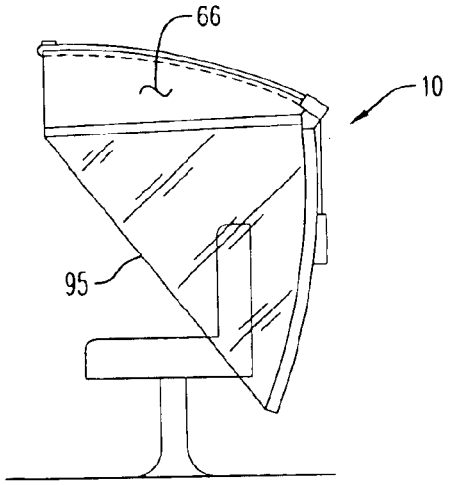
Figure 13E:
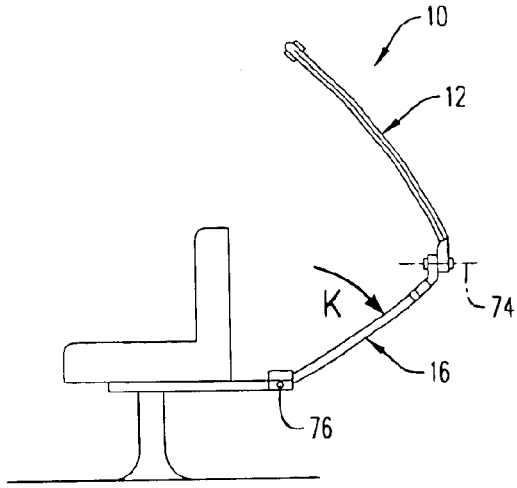

In FIG. 13C, the addition of the front protective panel 90 of FIG. 11 and the side protective panel 96 attached along a trailing edge of the canopy 14 as shown in FIG. 11 are depicted. In FIG. 13D, a transparent side panel 95 is there shown while in FIG. 13E, the substantial pivotal movement about axis 76 in the direction of arrow K of the entire device 10 is there shown which provides for weather protection from the rear or back side of the user when the canopy 14 is deployed and also shows an alternate stored position of the device 10 when the canopy is fully stored within the top spine 12.

Referring now to FIGS. 18, 19 and 20, various embodiments of the means for attaching the device 10 to various support structures are there shown. In FIG. 18A, the previously described swivel seat mount bracket 18 is there shown attached to a boat swivel seat S while in FIG. 18B, a floor bracket 82 into which the lower end 80 of the main spine 16 is releasably connectable. The floor mounting bracket 82 shown in FIG. 20 includes a cavity 84 for receiving the mating lower end 80 of the main spine 16 and is attachable by flanges and attaching fasteners (not shown) to the deck of, for example, a boat, dock or outdoor deck. Slots 88 receive the molded lower end 80 of the main spine 16 as earlier described in FIG. 9 after which tensioning handle 78 secures this arrangement for later quick release.

In FIG. 18C, the canopy apparatus 10 is shown connected at the lower end 80 of the main spine 16 to a butt seat R which is typically found on a fishing boat and the like. In FIG. 19, a mounting bracket 110 is there shown which provides cavity 112 and slots 114 for releasable interconnection of the molded lower end 80 of the main spine 16. This bracket embodiment 110 is connectable by orthogonally oriented flanges 116 to, for example, the gunnel of a boat, a bench-type seat and the like.

Referring now to FIGS. 21 to 24, several additional embodiments of the invention are there shown. All of these embodiments include the canopy apparatus 10 as previously described.

In FIG. 21, this embodiment 120 also includes a relatively short in height wrap-around side and back panel protector 122. This protector 122 includes side panels 124 and 128 and a rear panel 126 all of which are attached by zipper, VELCRO or snaps along the side and back margins 123 of the canopy apparatus 10.

The embodiment 130 in FIG. 22, includes an elongated side and back protector shown generally at 132 which also includes two front panel protectors 134 and 136 which are separable along a vertical separation line 138 by zipper, VELCRO or snaps. Again, this embodiment 130 includes conventional connectors of snaps, VELCRO or zipper along the leading edge 142 and the side and rear margins of the canopy apparatus 10.

In FIG. 23, this embodiment 150 again includes the canopy apparatus 10 as previously described, the protector panel arrangement 132 as described in FIG. 22, and a lower protector 152 which includes side and back panels 162 along with front panels 154 and 156 which are separate releasably connectable along vertical separation line 158. This lower protector 152 is attached along 160 by zipper, VELCRO or snaps. The length of the lower protector 152 is such as not to extend to the ground or support surface M but rather to leave a gap therebetween for air movement and circulation.

In the embodiment 170 shown in FIG. 24, the lower protector panel 152 as previously described with respect to FIG. 23 has been extended by ground panel 172 which releasably attaches along 180 to the lower protector 152. This ground protector extends down to the ground or support surface M having a side and back panel 182 and front panels 174 and 176 which are weighted at their lower margins for establishing and maintaining contact with support surface M. The front panels 176 and 178 are separable along vertical line of separation 178 by zipper, VELCRO or snaps.

All of these embodiments 120, 130, 150 and 180 may have these side, back and front panel additions fabricated of either flexible woven material or may alternately be formed of screen material for enhanced circulation. With respect to the embodiment 170 shown in FIG. 24, the screen or material being utilized will also render this embodiment 170 to be relatively insect-free.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A personal canopy apparatus for one or more individuals which is connectable to a separate structure, said canopy comprising:

an elongated main spine connectable at a lower end thereof about a first pivotal axis in a generally upright orientation to the separate structure;

an elongated top spine pivotally connected at a proximal end thereof about a second pivotal axis to an upper end of said main spine;

a retractable canopy including two flexible covers each of which is supported along a proximal edge thereof by said top spine, a leading edge support arm and a plurality of battens each connected to a respective one of said covers, said support arms and battens of each said cover being pivotally connected at a proximal end thereof about one of two closely spaced third pivotal axes at a distal end of said top spine whereby, when each of said covers are open in a fan-like manner, said support arms extend laterally in opposite directions from the distal end of said top spine to form a leading edge of said canopy and said battens are arranged in a spaced apart array radiating from said third pivotal axis;

said support arms, covers nd battens being positioned in closely aligned fashion along said top spine when said canopy is in a stored configuration.

2. A personal canopy apparatus as set forth in claim 1, wherein:

said main spine and said top spine have an arcuate shape, said main spine being telescopic in length.

3. A personal canopy apparatus as set forth in claim 1, wherein:

said second pivotal axis is oriented at an acute angle with respect to each of said spines whereby, when said top spine is selectively rotated about said second pivotal axis, said covers are correspondingly angularly oriented to one side of said main spine.

4. A personal canopy apparatus as set forth in claim 1, wherein:

each of said covers is individually deployable and storable along said top spine.

5. A personal canopy apparatus as set forth in claim 1, wherein the separate structure includes:

a pedestal/post mount attachable to a support surface.

6. A personal canopy apparatus as set forth in claim 1, wherein:

said top spine includes longitudinal slots formed along each side thereof for storing said support arms, covers and battens.

7. A personal canopy apparatus as set forth in claim 1, wherein:

said top spine is pivotable about said second axis into a stored position along side said main spine.

8. A personal canopy apparatus as set forth in claim 1, further comprising:

a flexible protective front panel attachable to and downwardly extending from each of said support arms.

9. A personal canopy apparatus as set forth in claim 8, wherein:

said front panel includes a transparent portion for forward viewing therethrough by the user.

10. A personal canopy apparatus for one or more individuals which is connectable to a separate structure, said canopy comprising:

an elongated main spine connectable at a lower end therof in a generally upright orientation the separate structure;

an elongated top spine pivotally connected at a proximal end thereof to an upper end of said main spine;

a retractable canopy including two flexible covers each of which is supported along a proximal edge thereof by said top spine, a leading edge support arm and a plurality of battens each supportively connected to each of said covers, said support arms and battens of each said cover being pivotally connected at a proximal end thereof to a forwardly distal end of said top spine whereby, when each of said covers are open, said support arms extend laterally in opposite directions from the forwardly distal end of said top spine to form a leading edge of said canopy and said battens are arranged in a spaced apart array radiating from the forwardly distal end of said top spine;

said support arms, covers and battens being positioned in closely aligned fashion against and along the length of said top spine when said canopy is in a stored configuration;

said main spine and said top spine arcuate in shape, said main spine being telescopic in length;

said pivotal axis between said spines being oriented at an acute angle with respect to each of said spines whereby, when said top spine is rotated, said covers are correspondingly angularly oriented between being an overhead, and a side position;

each of said covers being individually deployable and storable against said top spine;

said top spine including longitudinal slots formed along each side thereof for storing said support arms, covers and battens therein;

said tap spine being pivotable into a stored position along side said main spine.

11. A personal canopy apparatus for an individual which is connectable to a separate structure, said canopy comprising:

an elongated telescoping main spine connectable at a lower end thereof about a first horizontal pivotal axis in a generally upright orientation to the separate structure;

an elongated top spine pivotally connected at a proximal end thereof in a generally forwardly extending orientation to an upper end of said main spine about a second pivotal axis therebetween, said second axis being coplanar with said main spine and said top spine;

a retractable canopy including two individually deployable flexible covers each of which is connected along a proximal edge thereof to and extending along said top spine;

a leading edge support arm and a plurality of battens oh supportively connected to each of said covers, said support arm and battens of each said cover being pivotally connected at a forwardly proximal end thereof to a forwardly distal end portion of said top spine whereby, when each of said covers are open, said support arms extend laterally in opposite directions from the forwardly distal end of said top spine to form a leading edge of said canopy, said battens being arranged in a spaced apart array radiating from said forwardly proximal ends;

said support arms, covers and battens being bundled in closely aligned fashion against said top spine when said canopy is in a stored configuration;

said top spine including longitudinal slots formed along each side thereof for storing said support arms, covers and battens.

* * * * *

UNITED STATES PATENT AND TRADEMARK OFFICE

CERTIFICATE OF CORRECTION

PATENT NO. : 6,845,780 B2
DATED : January 25, 2005
INVENTOR(S) : Charles A. Bishirjian It is certified that error appears in the above-identified patent and that said Letters Patent is hereby corrected as shown below:

Column 10,
Line 33, replace "oh" with -- each --.

Signed and Sealed this

Third Day of May, 2005

JON W. DUDAS
*Director of the United States Patent and Trademark Office*